United States Patent [19]

Day

[11] 4,084,454

[45] Apr. 18, 1978

[54] SOCKET HEAD TOOL

[75] Inventor: Leon E. Day, West Memphis, Ark.

[73] Assignee: Polygon, Inc., Essex, Conn.

[21] Appl. No.: 647,649

[22] Filed: Jan. 8, 1976

[51] Int. Cl.[2] ..... B25B 13/48

[52] U.S. Cl. ..... 81/121 R; 81/71

[58] Field of Search ..... 7/1 G; 81/71, 121 R, 81/121 B, 177 A

[56] References Cited

U.S. PATENT DOCUMENTS

| | | | |
|---|---|---|---|
| 1,533,784 | 4/1925 | Bellows | 81/121 R |
| 1,567,877 | 12/1925 | Tuttle | 81/121 R |
| 1,689,585 | 10/1928 | Haschart | 81/121 R |
| 1,778,576 | 10/1930 | Walker | 81/121 R UX |
| 2,621,688 | 12/1952 | Wales | 81/71 X |
| 2,643,566 | 6/1953 | Dos Santos et al. | 81/71 |
| 3,289,503 | 12/1966 | Klatt, Jr. | 81/71 |
| 3,875,829 | 4/1975 | Evans et al. | 81/177 A X |

*Primary Examiner*—James L. Jones, Jr.
*Assistant Examiner*—James G. Smith
*Attorney, Agent, or Firm*—Prutzman, Hayes, Kalb & Chilton

[57] ABSTRACT

This invention relates to a new tool for loosening screw parts or like devices which are frozen in screw threaded connection in a metal work part, for example. The new tool includes hollow, cup-shaped socket including a thick solid upper end head portion and an integral hollow skirt portion for fitting over an exposed head of a frozen screw device, a short axial extent of the exposed head of the device being interlocked with the skirt when an inner rim portion on the skirt is in locked engagement with the work-part. A box-end wrench is provided having a non-circular opening in one end which fits over a complementary non-circular opening on the outer surface of the socket tool at a point intermediate the solid portion of the head and the rim, to extend radially from the head, so that an operator by applying tool-turning force to the handle of the wrench, in unscrewing direction, while repeatedly tapping the solid head portion with a hammer, may loosen the frozen screw device from the work-piece without damage to the screw connection, which would otherwise terminate the useful life of the work-piece and the device frozen thereto.

2 Claims, 7 Drawing Figures

SOCKET HEAD TOOL

BACKGROUND OF INVENTION

Heretofore, the known procedures used for freeing frozen bleeder valves from brake calipers, for example, have usually involved use of a special box-end wrench with a relatively long handle. However, in use of such wrenches the long handles created excessive torque action about the box-end which resulted in complete destruction of the bleeder valve and/or the box-end of the wrench without accomplishing removal of the valve, and the entire brake caliper had to be replaced with a new one more often than not. When a wrench with a short handle was used for the same purpose it was not possible for a worker or brake caliper repairman to turn the wrench by hand with sufficient force to release the frozen valve, and the end result was the necessity for replacing the whole brake caliper with a new one. Until conception of the present invention no wrench type tool has been available for reliable use in removing frozen bleeder valves from automotive brake calipers, for instance.

SUMMARY OF INVENTION

The loosening device of the present invention includes a cup-shaped tool socket body of hard metal, and including a solid outer axial head extent, and an axially downwardly extending hollow skirt portion terminating in a peripheral rim for firm stop engagement with a brake caliper surface, for example, to overlie a protruding stem portion of a frozen bleeder valve threaded into said surface. The hollow skirt portion of the tool body may, however, have a relatively short extent of hex or like gripping means for complementally interengaging with a like shaped gripping portion formed integrally on the valve stem. In some cases a screw driver device may have an integral hex head complementary to the hex means on the skirt portion so that the device may be used on frozen screw-head devices.

In any event, in use of the improved tool to remove a frozen bleeder valve from a brake caliper, for example, the hollow tool socket may be cupped over the valve until said peripheral rim of the skirt portion engages the surface of the caliper hex portion and the gripping portions are then complementally interlocked. In this condition the operator may apply the wrench head to a non-circular portion on the outer surface of the socket tool and then firmly grip the wrench handle in one hand, to urge the tool head in unscrewing direction while rapidly tapping the solid upper end portion of the tool head to cause full release of the threaded connection between the bleeder valve and the caliper.

A general object of the present invention is to provide a simple one-piece socket tool, which can be manually operated by one man, quickly to remove a frozen valve or like screw-threaded device from threaded connection with a workpiece, which otherwise would be scrapped if the frozen device could not be so removed.

Other objects of the invention will be manifest from the following brief description and the accompanying drawings.

In the accompanying drawings:

FIG. 4 shows the device of FIGS. 1 and 2 used with a screw driver device; while

Figure 1:
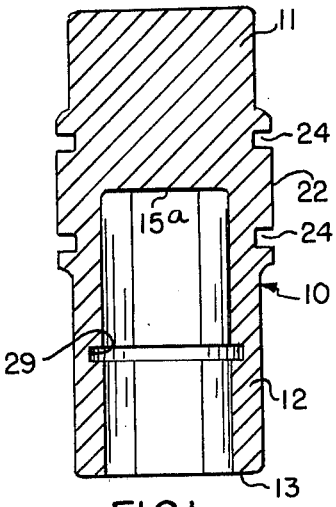
FIG. 1 is a central sectional view illustrating a one-piece socket tool in accordance with the invention, for use in releasing a frozen screw part from a work piece.
Figure 2:
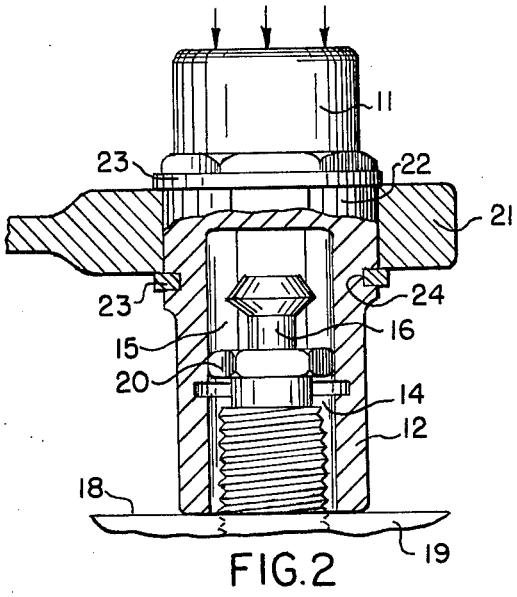
FIG. 2 is a view corresponding to FIG. 1, also on the same scale and partly broken away and in section, illustrating the use of the improved tool as applied to a bleeder valve which is frozen to a brake caliper for removing the bleeder valve by simultaneously turning the tool by the wrench handle and rapping the tool head with a hammer, as indicated by the arrows.
Figure 3:
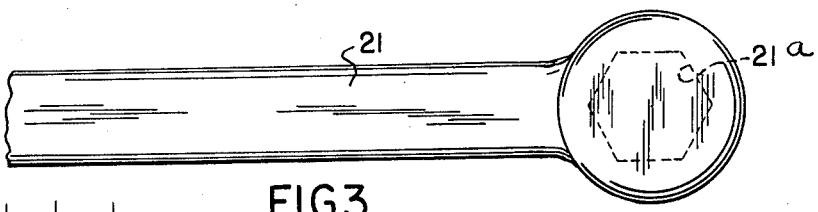
FIG. 3 is a plan view of a portion of a wrench for use as seen in FIG. 2.

Referring to FIGS. 1 and 2 of the drawings, there is illustrated the improved one-piece tool of the invention including generally cup-shaped socket head 10, made of hard durable metal such as steel and having a solid, thick upper extension 11, from which an integral annular skirt portion 12 extends downwardly of the head 10 to terminate in a freely presented peripheral rim or edge 13. The hollow space 14, defined by the inner wall 15 of the skirt portion 12, is of substantial axial depth adapted to receive a frozen screw part, such as bleeder valve 16 freely therein when the head is cupped over the same until the rim 13 is firmly seated on a flat surface 18 of a work piece, such as the automotive brake caliper 19, as shown in FIG. 2. The inner wall 15 is shown as being of hexagonal shape or cross-section, for complemental gripping reception of a nut-like hexagonal portion 20 rigid on the valve, for use of the tool in a manner to be described later.

Affixed to the tool head 10, at a point axially intermediate the rim 13 and the solid upper head portion 11, there is attached a wrench 21 which has a non-circular, hex, opening 21*a* which fits snugly a non-circular, hex, surface 22 on the socket tool 10, and which extends generally radially of the axis of the head 10. Snap rings 23 may be placed in outwardly opening annular recesses 24 in the tool 10 above and below the wrench to hold it in position.

For use and operation of the improved tool, for removing a bleeder valve 16 from an automotive brake caliper 19, particular reference is now made to FIG. 2. With the skirt 12 of the tool head 10 tightly fitted or gripped over hex part 20 of a frozen threaded valve 16, as described, the operator while applying a steady turning pressure on the wrench handle 21 with one hand uses his other hand for repeated application of sharp hammer blows on the solid upper end of the tool head as indicated by the arrows. This dual action of turning and hammering creates a rapid series of percussion shocks which travel down through the skirt to the tightly gripped portion of the valve, thereby to loosen the threaded connection between the valve and the caliper, whereby with continued steady turning of the tool handle the valve is easily unscrewed from the caliper without damage to either the valve or the caliper. Due to the wrench handle being affixed to the head 10 at a point below the solid top part 11, the resultant jarring effect passing downward from said solid head part travels through the skirt to the threaded connection, with a minimum degree of jarring effect being applied to the wrench handle 21 and thereby resulting in full release of the frozen valve from the caliper, all with a minimum degree of resistance to turning movement of the tool. Moreover, use of the improved tool is capable of removing a high percentage of frozen bleeder valves, if not all, from automotive brake calipers, with resultant high savings made possible by reuse of calipers which, but for the present invention, would otherwise be scrapped and replaced by new calipers. It could also be applied to release many other frozen screw parts from work-pieces holding such parts.

Figure 4:
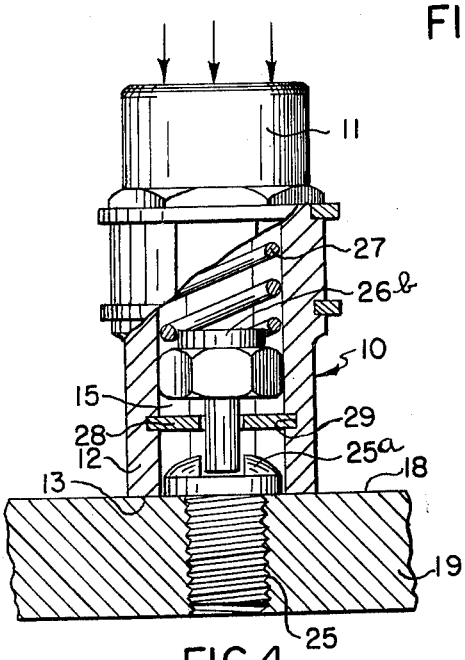
Figure 5:
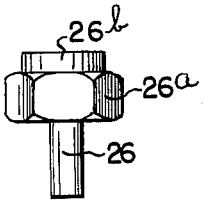
FIGS. 5, 6 and 7 are forms of screwdriver devices for use in FIG. 4.

The identical socket tool 10, as above described, can have an added screwdriver part to release threaded parts having screw heads as disclosed in FIGS. 4, 5, 6 and 7. This use of the tool socket is illustrated in FIG. 4 as applied to a screw 25 threaded in the workpiece 29 and having a common screw head 25*a* having a single slot extending diametrically across the same. In this case, an extra small tool, such as seen in FIGS. 4 and 5 comprises a screwdriver blade 26 having an integral hexagon head 26*a* adapted to snugly fit in the inner wall 15 of the skirt 12, which is of hexagon shape also. A strong helical compression spring 27, of a size to fit snugly in the opening of the skirt 12, is held, as seen in FIG. 4, between the top of the screwdriver 26 and the top surface 15*a* of the chamber inside of the skirt 12. Preferably, a short cylindrical projection 26*b* at the top of the screwdriver is provided to hold the spring 27 centrally of the housing of the skirt 12. In use of this device it is preferable to insert a snap ring 28 in an inwardly opening annular slot 29 in the skirt 12 to hold the screwdriver within the skirt.

Figure 6:
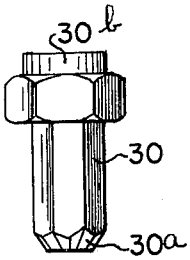
Figure 7:
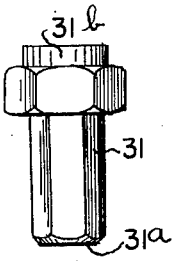

Other screwdrivers may be provided as shown in FIGS. 6 and 7, FIG. 6 being for use with Allen head screws and, therefore, having a screwdriver end 30 having a shape at its lower end 30*a* to fit an Allen head screw, or the screwdriver 31 in FIG. 7 may have its lower end 31*a* cut to fit an Allen head screw. In both FIG. 6 and 7 it is preferable to have an upwardly extending projection 30*b* or 31*b* to center the spring 27 when in the position of FIG. 4.

In use of the device of FIG. 4, socket tool 10 is placed over the screw head 25*a* of the screw having threads frozen in the workpiece 19, then the wrench 21 is placed in position on the tool the same as that shown in FIG. 2 and the operator uses one hand to turn the wrench in a screw unthreading direction while he hammers on the top of the solid head portion 11 with a hammer in the direction of the arrows shown in FIG. 4. In this case, the same as in FIG. 2, the depth of the central opening in the skirt 12 is long enough to encompass the threaded part to be removed while placing the terminal lower end 13 of the skirt firmly on the workpiece 18. Thus, the blows of the hammer delivered on top of the head piece 11 is transmitted to the frozen threads 25 and aids in the loosening of the threads by means of the wrench 21.

Each bit or attachment shown in FIGS. 5, 6 and 7 depends on spring 27 to hold the point of the attachment in turning engagement with the notch in the screw. Unless spring 27 is strong enough, the vibration of the tapping at the upper end would cause the point to bounce out of the slot.

The tool socket described herein uses the terms "solid upper axial head" and "downwardly extending hollow skirt portion below said head". These terms are used for the purpose of description and are not intended to limit the use of the device in a vertical position.

What is claimed is:

1. A tool for loosening a frozen threaded part of the type which is screw-threaded into a work-piece and has a unitary turning head freely exposed outwardly of a surface of the work-piece, said tool comprising a generally cup-shaped, elongated socket tool body having means for receiving hammer-like blows, said means comprising a solid upper axial head and an axially downwardly extending hollow skirt portion below said head terminating in a peripheral lower rim, said skirt portion having an internal depth greater than the height of the work-piece head above the work-piece to completely house the head when said lower rim is in engagement with said work-piece, said solid head being spaced from the upper end of said threaded part, said skirt portion being provided with an internal non-circular surface to provide driving engagement with the gripping portions of the threaded part, said tool socket body having non-circular outer surface axially intermediate said upper head and said lower rim for engagement by a complementary non-circular opening of a wrench but slidable axially relative to the wrench, whereby, with said tool socket body positioned over the head of said threaded part and with its lower rim resting on said work-piece, application of hammer-like blows to said solid upper axial socket head produces jarring forces passing from said upper head through the skirt to the work-piece without substantial transfer of said forces to the threaded part and to the wrench.

2. The tool as set forth in claim 1 wherein an intermediate driving member is spring mounted for limited axial movement within said socket, said intermediate driving member having an external non-circular surface in complementary engagement with the internal non-circular surface of the socket skirt, the lower end of said intermediate driving member having a configuration suitable for establishing driving engagement with head of the threaded part.

* * * * *